US008428497B2

(12) United States Patent
Wada et al.

(10) Patent No.: US 8,428,497 B2
(45) Date of Patent: Apr. 23, 2013

(54) DEVELOPING DEVICE AND IMAGE FORMING APPARATUS PROVIDED WITH SAME

(75) Inventors: Minoru Wada, Osaka (JP); Seishi Ojima, Osaka (JP); Sayo Mabuchi, Osaka (JP)

(73) Assignee: Kyocera Mita Corporation (JP)

( * ) Notice: Subject to any disclaimer, the term of this patent is extended or adjusted under 35 U.S.C. 154(b) by 298 days.

(21) Appl. No.: 12/880,600

(22) Filed: Sep. 13, 2010

(65) Prior Publication Data

US 2011/0064484 A1 Mar. 17, 2011

(30) Foreign Application Priority Data

Sep. 16, 2009 (JP) ..... 2009-214269
Sep. 16, 2009 (JP) ..... 2009-214271

(51) Int. Cl.
*G03G 15/09* (2006.01)

(52) U.S. Cl.
USPC ..... 399/274; 399/284

(58) Field of Classification Search ..... 399/274, 399/284
See application file for complete search history.

(56) References Cited

U.S. PATENT DOCUMENTS 5,623,718 A * 4/1997 Bracken et al. ..... 399/284
5,805,966 A * 9/1998 Yamada ..... 399/284
2011/0064485 A1* 3/2011 Ojima et al. ..... 399/274

FOREIGN PATENT DOCUMENTS

JP 5-88540 4/1993
JP 2007-147915 6/2007

* cited by examiner

*Primary Examiner* — Walter L Lindsay, Jr.
*Assistant Examiner* — Benjamin Schmitt
(74) *Attorney, Agent, or Firm* — Gerald E. Hespos; Michael J. Porco; Matthew T. Hespos

(57) ABSTRACT

A developing device includes a developer storing portion, a developer carrying body, a first regulating member having a first regulating surface regulating a layer thickness of the developer on the developer carrying body, a second regulating member having a second regulating surface that is set so as to gradually become apart from the developer carrying body toward the upstream side with respect to the rotation direction of the developer carrying body to regulate an amount of the developer conveyed to the first regulating surface, the second regulating surface being arranged with a step formed between the second regulating surface and the first regulating surface, and a sheet member so attached to the second regulating surface as to cover at least a portion of the step between the first regulating surface and the second regulating surface.

14 Claims, 7 Drawing Sheets

FIG.4

| | DEVELOPER LAYER CONVEYANCE AMOUNT | | IMAGE DENSITY (IMAGE DEGRADATION) |
|---|---|---|---|
| | 0.3mm | 0.4mm | |
| PRACTICAL EXAMPLE 1 | 7.3mg/cm$^2$ | 7.6mg/cm$^2$ | ○ |
| PRACTICAL EXAMPLE 2 | 7.5mg/cm$^2$ | 9.2mg/cm$^2$ | ○ |
| COMPARATIVE EXAMPLE 1 | 7.5mg/cm$^2$ | 12.3mg/cm$^2$ | × |

FIG.9

| | STATE OF MAGNETIC BRUSH | STREAK NOISE | IMAGE DENSITY |
|---|---|---|---|
| PRACTICAL EXAMPLE 3 | ○ | ○ | ○ |
| PRACTICAL EXAMPLE 4 | ○ | ○ | △ |
| COMPARATIVE EXAMPLE 2 | × | × | ○ |
| COMPARATIVE EXAMPLE 3 | × | × | △ |

DEVELOPING DEVICE AND IMAGE FORMING APPARATUS PROVIDED WITH SAME

BACKGROUND OF THE INVENTION

1. Field of the Invention

The present invention relates a developing device that forms a toner image on a predetermined image carrying body and to an image forming apparatus provided with the same.

2. Description of the Related Art

Image forming apparatuses that use an electrophotographic method, such as copiers, printers, fax machines, and multifunction machines that combine these, include a developing device supplying a toner to an image carrying body (for example, a photosensitive drum or transfer belt) to form a toner image on the image carrying body.

The developing device includes, as fundamental elements, a developer storing portion which stores a developer constituted by a toner and a carrier, a developing roller which forms a toner image on an image carrying body by receiving the developer from the developer storing portion and supplying the developer to the image carrying body, and a regulating blade which is arranged in opposition to a circumferential surface of the developing roller and regulates a layer thickness of the developer on the developing roller.

In the thus configured developing device, a gap of a predetermined dimension is set between a leading edge surface of the regulating blade facing the developing roller and the circumferential surface of the developing roller, and a developer layer of a uniform layer thickness is formed on the circumferential surface of the developing roller by causing the developer that has adhered to the circumferential surface of the developing roller from the developer storing portion to pass through this gap.

However, the developer tends to accumulate in a space on an upstream side from the regulating blade as viewed from the rotation direction of the developing roller, and within this space, toner deterioration due to bury of external additives to the toner or separation of external additives from the toner, or carrier deterioration due to adhesion of toner external additives to the carrier occurs since, for example, the developers rub against each other. When the developer deteriorates in this manner, the toner cannot be favorably charged. Furthermore, when the developer, which is a magnetic substance, accumulates on the upstream side of the regulating blade, it is difficult to focus a magnetic line, which is produced between the regulating blade and the developing roller, on the regulating blade, and the regulating force of the regulating blade does not stabilize. As a result, it becomes difficult to form a uniform layer thickness of developer on the circumferential surface of the developing roller, and thus also difficult to form a favorable toner image.

A first prior art and a second prior art are known as techniques that inhibit the above-mentioned deterioration of the developer. In a developing device of the first prior art, a carrier returning member is arranged on an upstream side from the regulating blade as viewed from the rotation direction of the developing roller and at a position adjacent to the regulating blade. The carrier returning member is provided with a guiding conveyance surface that opposes the circumferential surface of the developing roller, and the guiding conveyance surface is tilted so that a space between the guiding conveyance surface and the developing roller gradually becomes larger from the regulating blade toward the rotation direction upstream side.

The developer that adheres to the circumferential surface of the developing roller from the developer storing portion advances into this space due to rotation of the developing roller, and is thus gradually pushed back to the developer storing portion by the tilted surface of the guiding conveyance surface. Due to this, a large amount of developer is suppressed from accumulating on the upstream side from the regulating blade in the rotation direction of the developing roller.

In a developing device of the second prior art, an elastic member is arranged in the upstream side space where the developer tends to accumulate. The elastic member is arranged so as to occupy the upstream side space in a state in which the elastic member is in close contact to the upstream surface of the regulating blade as viewed from the rotation direction of the developing roller. Since the upstream side space is occupied by the elastic member, the developer is suppressed from accumulating there.

Furthermore, the elastic member has a conveyance amount regulating surface that opposes the circumferential surface of the developing roller. The conveyance amount regulating surface is set so as to gradually be more apart from the developing roller toward the upstream side in the rotation direction of the developing roller, and therefore the developer that adheres to the circumferential surface of the developing roller from the developer storing portion advances into the upstream side space due to rotation of the developing roller, and is thus gradually pushed back to the developer storing portion by the conveyance amount regulating surface. Due to this, a large amount of the developer is suppressed from accumulating on the upstream side from the regulating blade in the rotation direction of the developing roller.

However, in the developing device of the first prior art, a step is formed between the end surface of the regulating blade and the guiding conveyance surface of the carrier returning member due to factors such as dimensional precision and installation precision of the carrier returning member, and therefore the developer tends to accumulate in the step. As described above, when the developer accumulates, the developer deteriorates and it becomes difficult to form a developer layer having a uniform layer thickness on the circumferential surface of the developing roller.

Furthermore, since the elastic member in the second prior art is a member having a thickness enough to occupy the upstream side space, in the case where the elastic member deforms due to heat produced in the developing device, the extent of thermal deformation tends to increase. When the extent of thermal deformation of the elastic member increases, a gap is produced between the elastic member and the upstream surface of the regulating blade, and the developer enters the gap and accumulates in this gap. Furthermore, when the elastic member deforms, the position of the conveyance amount regulating surface changes, and therefore in consideration of this change, the step between the regulating surface of the regulating blade and the conveyance amount regulating surface becomes undesirably larger, so that the developer tends to accumulate. Thus, as described above, when the developer accumulates, developer deterioration occurs and, as a result, it becomes difficult to form a toner layer having a uniform layer thickness on the circumferential surface of the developing roller.

SUMMARY OF THE INVENTION

Accordingly, in light of the above circumstances, an object of the present invention is to provide a developing device and an image forming apparatus provided with this in which a developer layer having a uniform layer thickness is formed by suppressing accumulation of developer, thereby enabling a favorable toner image to be formed.

To achieve this object, a developing device according to one aspect of the present invention includes: a developer storing portion storing a developer; a developer carrying body receiving the developer from the developer storing portion to supply the developer to a predetermined image carrying body while rotating in a predetermined direction; a first regulating member having a first regulating surface that opposes the developer carrying body and regulates a layer thickness of the developer carried on the developer carrying body; a second regulating member having a second regulating surface that is positioned more upstream than the first regulating surface with respect to a rotation direction of the developer carrying body and that is set so as to gradually become apart from the developer carrying body toward the upstream side with respect to the rotation direction of the developer carrying body to regulate an amount of the developer conveyed to the first regulating surface, the second regulating surface being arranged with a step formed between the second regulating surface and the first regulating surface; and a sheet member so attached to the second regulating surface as to cover at least a portion of the step between the first regulating surface and the second regulating surface.

Other further objects of the present invention and specific advantages enabled by the present invention will become more evident through description of working embodiments described hereinafter.

BRIEF DESCRIPTION OF THE DRAWINGS

FIG. 4 is a diagram showing results of experiments carried out regarding conveyance amount of developer layer per unit area and image densities.

FIG. 9 is a diagram showing results of experiments carried out regarding a state of magnetic brush, streak noise, and image densities.

DETAILED DESCRIPTION OF THE PREFERRED EMBODIMENTS

Hereinafter, illustrative embodiments of the present invention are described in detail with reference to the accompanying drawings. It should be noted that in one embodiment of the present invention described below, a monochrome type printer is shown as an image forming apparatus, but the present invention is not limited to this and is applicable also to other image forming apparatuses such as copiers, fax machines, and multifunction machines having a combination of these functions.

Figure 1:
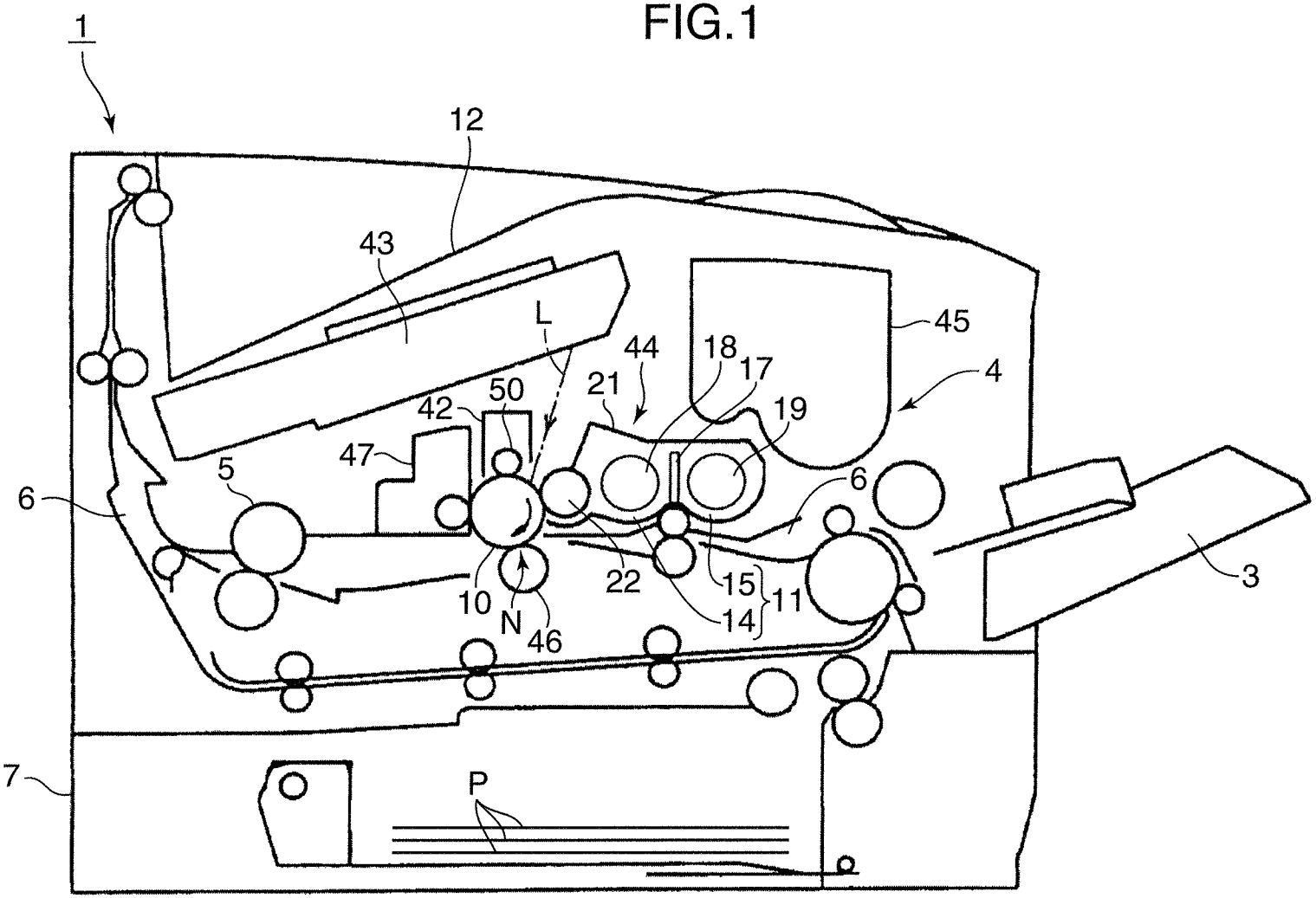
FIG. 1 is a diagram that schematically shows an internal structure of an image forming apparatus.

FIG. 1 is a diagram that schematically shows an internal structure of an image forming apparatus. An image forming apparatus 1 includes an image forming unit 4, which forms a toner image on a paper (sheet) P based on image data from an external source (for example, a personal computer), a fixing unit 5, which heats the toner image formed on the paper P to cause it to fix onto the paper P, a paper feeding cassette 7 that contains the papers P, a paper discharge tray 12 on which the papers P are discharged, a conveyance path 6 that conveys the papers P from the paper feeding cassette 7 to the paper discharge tray 12 via the image forming unit 4 and the fixing unit 5, a manual tray 3, which is provided on a right lateral surface of the image forming apparatus 1 in FIG. 1, and an operation section (not shown in drawings) on which are arranged a plurality of menu setting keys and the like for setting various menus.

The image forming unit 4 includes a photosensitive drum (image carrying body) 10, a charger 42 that executes a charging process on the photosensitive drum 10, an exposure device 43, which radiates a laser beam L onto the charged photosensitive drum 10 to form an electrostatic latent image, a developing device 44, which causes toner to electrostatically adhere to the electrostatic latent image formed on the photosensitive drum 10 to form a toner image, a toner cartridge 45 internally filled with toner to be supplied to the developing device 44, a transfer roller (transfer member) 46 that transfers the toner image onto the paper P, and a toner removing device 47 that removes and collects toner that is residual on the surface of the photosensitive drum 10. It should be noted that the charger 42, the developing device 44, the transfer roller 46, and the toner removing device 47 are arranged in order around the photosensitive drum 10 as viewed from the rotation direction of the photosensitive drum 10 (clockwise direction in FIG. 1). Furthermore, the exposure device 43 is arranged above the charger 42.

The photosensitive drum 10 for example is a drum having a photosensitive structure in which an amorphous silicone layer, which is a positively charged photoconductive material, has been deposited on a surface of an aluminum cylinder. A layer thickness of the amorphous silicone layer and a linear velocity of the photosensitive drum 10 are set appropriately.

The charger 42 includes a charging roller 50 for example. The charging roller 50 is constituted by a metal core and an epichlorohydrin rubber layer that covers this core. Furthermore, the charging roller 50 uses a contact charging method in which its circumferential surface makes substantial point-contact with a drum surface of the photosensitive drum 10, and uniformly charges the surface electric potential of the drum surface by applying a predetermined reference charging voltage (reference charging bias), in which a direct current voltage and an alternating current voltage are superimposed, to the drum surface.

The exposure device 43 has a polygonal mirror (not shown in drawings) that guides the laser beam L to the drum surface of the photosensitive drum 10 based on image data inputted from an external PC (personal computer) or the like. The polygonal mirror forms an electrostatic latent image on the drum surface by scanning the laser beam L onto the drum surface of the photosensitive drum 10 while being rotated by a predetermined drive source. The developing device 44 supplies toner to the electrostatic latent image to form a toner image on the drum surface.

The transfer roller 46 is pressed against the drum surface of the photosensitive drum 10 in the conveyance path 6, and a nip area N is formed between the transfer roller 46 and the drum surface. A voltage of an opposite polarity to the surface electric potential of the drum surface is applied to the transfer roller 46, and therefore the toner image on the drum surface is transferred to the paper P when the paper P passes through the nip area N. The paper P that has passed through the nip area N is conveyed to the fixing unit 5 via the conveyance path 6.

After the toner image on the paper P is thermally fixed onto the paper P in the fixing unit 5, the paper P is conveyed to the paper discharge tray 12 via the conveyance path 6.

First Embodiment

Figure 2:
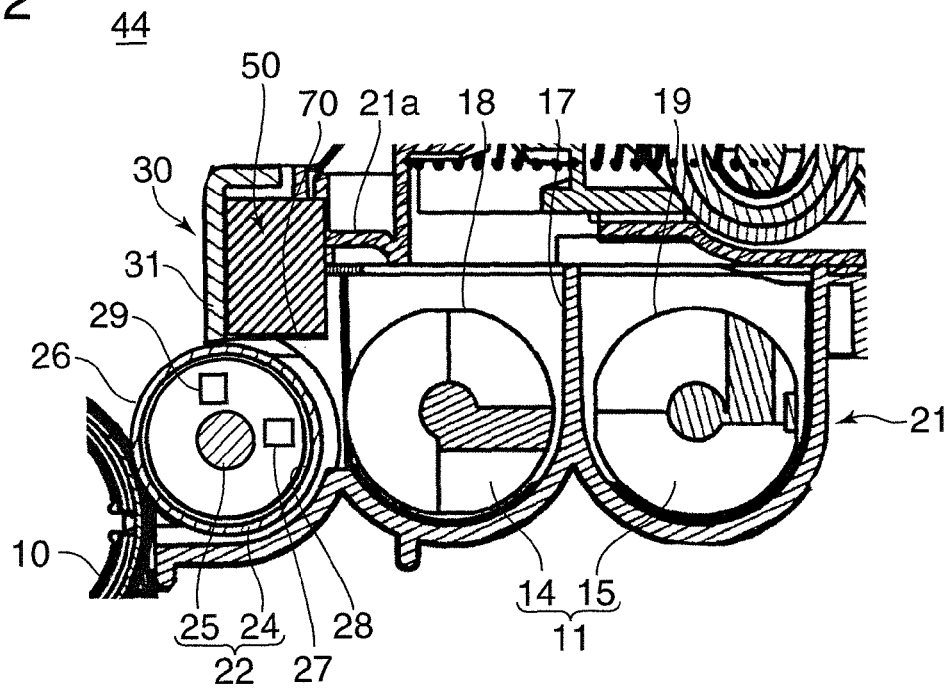
FIG. 2 is an enlarged view of a developing device according to a first embodiment.

Hereinafter, detailed description is given regarding the developing device 44 according to a first embodiment with reference to FIG. 2 in addition to FIG. 1. FIG. 2 is an enlarged view of the developing device 44. The developing device 44 uses a two-constituent developer containing a mixture of a nonmagnetic toner and a magnetic carrier, and as shown in FIG. 1 and FIG. 2, includes, as fundamental elements, a development vessel 21 that defines an internal space of the developing device 44, a developer storing portion 11 that is formed in bottom walls of the development vessel 21, and a developing roller 22 arranged at a development opening of the development vessel 21.

The developer storing portion 11 is constituted by two neighboring developer storage chambers 14 and 15 that extend in a longitudinal direction (a vertical direction with respect to the paper plane of FIG. 1) of the developing device 44. The developer storage chambers 14 and 15 are partitioned from each other in the longitudinal direction by a partitioning panel 17 constituted by a metal such as aluminum for example, but communicate with each other at both end portions in the longitudinal direction.

Furthermore, screw feeders 18 and 19 that stir and convey the developer by rotating are rotatably mounted in the developer storage chambers 14 and 15. The screw feeders 18 and 19 are set having their conveyance direction in an opposite direction to each other, and therefore the developer is conveyed while being stirred between the developer storage chamber 14 and the developer storage chamber 15. Due to this stirring, the nonmagnetic toner and the magnetic carrier are mixed, and the toner is charged by the carrier. The developer storing portion 11 receives toner from the toner cartridge 45 via an unshown replenishment opening.

The developing roller 22 is a roller member including a tube shaped developing sleeve 24 made of a nonmagnetic material such as aluminum, for example and extending in the longitudinal direction of the developing device 44 (that is, axial direction of the photosensitive drum 10), and an unshown rotation shaft that causes the developing sleeve 24 to rotate in a counterclockwise direction in FIG. 2.

The developing sleeve 24 is arranged in opposition to the photosensitive drum 10 with a gap of 0.2 mm to 0.4 mm formed between its outer circumferential surface 26 and the drum surface of the photosensitive drum 10. Inside the developing sleeve 24, a take-up pole 27 supported on a support shaft 25 is arranged close to an inner circumferential surface 28 of the developing sleeve 24. The take-up pole 27 is arranged in opposition to the developer storage chamber 14 through the outer circumferential surface 26 of the developing sleeve 24, and causes developer inside the developer storage chamber 14 to magnetically adhere onto the outer circumferential surface 26 of the developing sleeve 24.

The developer on the outer circumferential surface 26 of the developing sleeve 24 is carried toward the drum surface of the photosensitive drum 10 along with rotation of the developing sleeve 24, and adheres to the electrostatic latent image of the drum surface of the photosensitive drum 10 due to the electric potential difference between a development bias applied to the developing sleeve 24 and a drum bias applied to the photosensitive drum 10. Due to this, a toner image is formed on the drum surface, but to forma favorable toner image, it is necessary to make uniform the developer that has adhered on the outer circumferential surface 26 of the developing sleeve 24 using the take-up pole 27 before the developer adheres to the drum surface.

In the present embodiment, a developer regulating blade 30, a developer returning member 50, and a sheet member 70 are employed as means for forming a developer layer of a uniform layer thickness on the outer circumferential surface 26 of the developing sleeve 24.

Figure 3:
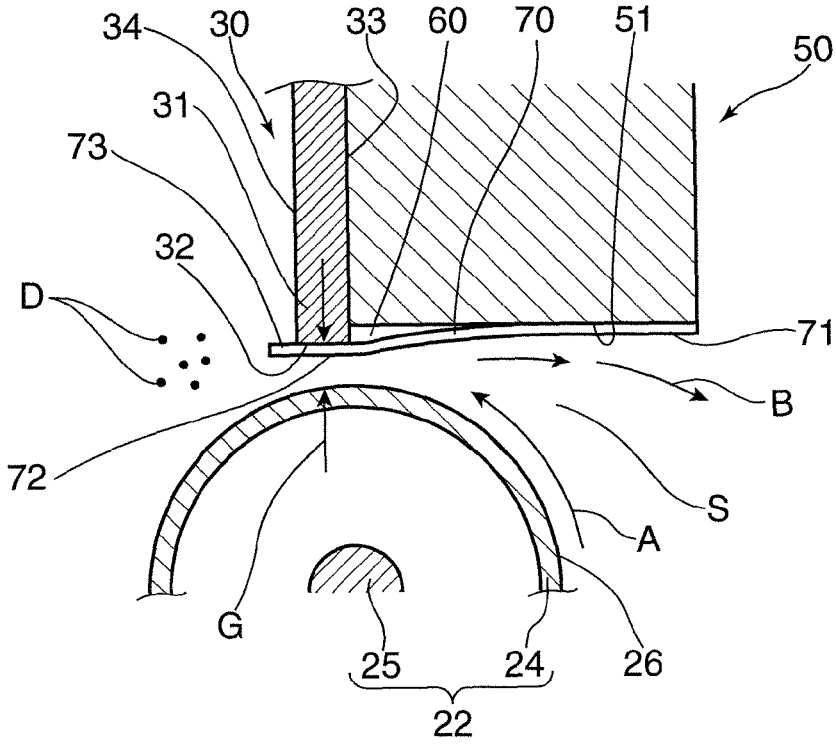
FIG. 3 is an enlarged view of a regulating means and peripheral portions thereof in the developing device of FIG. 2.

The developer regulating blade (first regulating member) 30 is arranged above the developing roller 22 in FIG. 2, and is a member constituted by a plate shaped magnetic material extending in an axial direction of the developing sleeve 24, and as shown in FIG. 3, is provided with a end 31 extending toward the outer circumferential surface 26 of the developing sleeve 24. The end 31 is provided with an end surface (hereinafter referred to as a first regulating surface) 32 that opposes the outer circumferential surface 26. As is described later, the developer regulating blade 30 regulates the layer thickness of the developer on the outer circumferential surface 26 of the developing sleeve 24 using the first regulating surface 32.

The developer returning member (second regulating member) 50 is a member constituted by a nonmagnetic material arranged on one side surface 33 of the developer regulating blade 30 that faces an internal space of the development vessel 21, and has a flat surface (hereinafter referred to as a second regulating surface) 51 that opposes the outer circumferential surface 26 of the developing sleeve 24. The second regulating surface 51 is positioned on an upstream side from the first regulating surface 32 of the developer regulating blade 30 as viewed from the rotation direction of the developing sleeve 24, and is set so as to gradually become apart from the developing sleeve 24 toward the upstream side of the rotation direction. In other words, the second regulating surface 51 is set so that a space S between the second regulating surface 51 and the outer circumferential surface 26 of the developing sleeve 24 gradually increases toward the upstream side in the rotation direction of the developing sleeve 24 from the first regulating surface 32 of the developer regulating blade 30. As is described later, the developer returning member 50 regulates the amount of the developer conveyed to the first regulating surface 32 using the second regulating surface 51.

Furthermore, it is preferable that the developer returning member 50 is formed integrally with the development vessel 21. Specifically, the development vessel 21 is provided with a main-body frame 21*a* that constitutes the development vessel 21, and the developer returning member 50 is formed integrally with the main-body frame 21*a*.

Although it is preferable that the first regulating surface 32 of the developer regulating blade 30 and the second regulating surface 51 of the developer returning member 50 are ideally on the same plane, a step 60 tends to be formed between the first regulating surface 32 and the second regulating surface 51 due to factors such as dimensional precision and installation precision of the developer returning member 50. In other words, the first regulating surface 32 and the second regulating surface 51 are positioned on different planes.

In the present embodiment, a sheet member 70 is attached from the first regulating surface 32 to the second regulating surface 51. The sheet member 70 extends across substantially the entire width direction of the developer regulating blade 30 and the developer returning member 50 (that is, the axial direction of the developing sleeve 24). Due to this, the step 60 is covered by the sheet member 70.

The sheet member 70 is a material having elasticity, examples of which include metal foil such as SUS, resin sheets such as PET, acrylic, nylon, high molecular weight PE, PPS, and PI, and rubber-based sheets such as urethane and silicone. In the first embodiment, an acrylic sheet having a thickness of 125 μm is used as the sheet member 70.

It is not necessary for the sheet member 70 to be attached in close contact to the step 60 along the shape of the step 60, and it is sufficient for the sheet member 70 to be attached so as to be able to cover the step 60. Although there is no particular limitation to the attachment of the sheet member 70 to the first regulating surface 32 and the second regulating surface 51, in the present embodiment, the sheet member 70 is affixed to an upstream portion of the second regulating surface 51 as viewed from the rotation direction of the developing sleeve 24 (a right side portion in FIG. 2 and FIG. 3) using a double-sided tape having an approximate width of 5 mm (a width as viewed from left and right directions in FIG. 2 and FIG. 3). Furthermore, the sheet member 70 may be affixed not only the second regulating surface 51, but also to the first regulating surface 32 using double-sided tape or the like.

Furthermore, when the portion of the sheet member 70 affixed using double-sided tape is set as a base end 71, a leading end 72 of the sheet member 70 exceeds the step 60 and extends to the first regulating surface 32 of the developer regulating blade 30. By extending the leading end 72 of the sheet member 70 to the first regulating surface 32, the step 60 can be reliably covered.

Furthermore, the leading end 72 of the sheet member 70 has an extension portion 73 that extends exceeding a downstream edge of the first regulating surface 32 as viewed from the rotation direction of the developing sleeve 24. The extension portion 73 protrudes on the side of the other side surface 34 of the developer regulating blade 30 that faces an external space of the development vessel 21. It should be noted that the extension portion 73 may also be flush with the downstream edge of the first regulating surface 32.

With the thus-attached sheet member 70, the developer regulating blade 30 and the developer returning member 50 oppose the developing roller 22 through the sheet member 70.

A gap G of a predetermined size is set through the sheet member 70 between the first regulating surface (end surface) 32 of the developer regulating blade 30 and the outer circumferential surface 26 of the developing sleeve 24. A regulating pole 29 (FIG. 2) constituted by a magnet is arranged in a state supported by the support shaft 25 at a position in opposition to the first regulating surface 32 inside the developing sleeve 24. Accordingly, a magnetic path, a so-called magnetic shield, is formed between the first regulating surface 32 and the regulating pole 29.

In the thus-configured developing device 44, a developer layer having a uniform layer thickness is formed in a following manner. Namely, the developer that has adhered to the outer circumferential surface 26 of the developing sleeve 24 from the developer storage chamber 14 due to the take-up pole 27 (FIG. 2) gradually approaches the second regulating surface 51 of the developer returning member 50 along with rotation of the developing sleeve 24 as shown by an arrow A. The developer is conveyed to the space S between the second regulating surface 51 and the outer circumferential surface 26 of the developing sleeve 24, but the space S narrows toward the downstream side with respect to the rotation direction of the developing sleeve 24. For this reason, a portion of the developer being conveyed is gradually pushed back in an opposite direction (arrow B) to the rotation direction of the developing sleeve 24 by the second regulating surface 51 via the sheet member 70 and returns to the developer storage chamber 14. In this way, the amount of the developer conveyed to the first regulating surface 32 is regulated using the second regulating surface 51. Due to this, the developer is suppressed from accumulating in large amounts on the upstream side in the gap G as viewed from the rotation direction of the developing sleeve 24. Furthermore, since the step 60 is covered by the sheet member 70, the developer is also prevented from accumulating in the step 60.

Then, as the developer passes the gap G, the layer thickness of the developer is regulated by the first regulating surface 32 of the developer regulating blade 30 and an effect of the magnetic shield. Due to this, a developer layer of a predetermined thickness, a so-called magnetic brush layer, is uniformly formed on the outer circumferential surface 26 of the developing sleeve 24. It should be noted that the material and thickness of the sheet member 70 are selected so as not to disturb the formation of the magnetic shield, and therefore a uniform developer layer is formed without hindrance.

In the thus-configured developing device 44 described above, the step 60 is formed between the first regulating surface 32 of the developer regulating blade 30 and the second regulating surface 51 of the developer returning member 50 due to factors such as the dimensional precision and installation precision of the developer returning member 50, but the sheet member 70 is attached extending from the first regulating surface 32 to the second regulating surface 51, and therefore the step 60 is covered by the sheet member 70. Accordingly, the developer carried by the developing sleeve 24 is prevented from accumulating in the step 60.

When the developer accumulates undesirably in the step 60, the developer moves in the step 60 while being confined by the magnetic force of the regulating pole 29. For this reason, the developers rub each other in the step 60, causing toner deterioration due to bury of external additives in the toner or separation of external additives from the toner, or carrier deterioration due to adhesion of toner external additives to the carrier.

However, since the step 60 is covered by the sheet member 70, the developer can be suppressed from deteriorating. Furthermore, the magnetic line produced between the first regulating surface 32 of the developer regulating blade 30 and the regulating pole 29 can be stabilized and focused on the first regulating surface 32. As a result, it is possible to form a uniform layer thickness of the developer on the outer circumferential surface 26 of the developing sleeve 24, and thus also possible to form a favorable toner image.

Furthermore, the sheet member 70 is provided with the extension portion 73, and therefore developer D floating around the developing sleeve 24 for example can be suppressed from entering between the first regulating surface 32 and the sheet member 70.

Furthermore, the developer returning member 50 is formed from a nonmagnetic material, and therefore the magnetic flux density between the first regulating surface 32 of the developer regulating blade 30, which is formed from a magnetic material, and the regulating pole 29 of the developing sleeve 24 is increased, and the magnetic shield is not disturbed. Due to this, it becomes easy to uniformly regulate the layer thickness of the developer.

Further still, the developer returning member 50 is formed integrally with the main cover 21*a* of the development vessel 21, and therefore the number of components can be reduced and costs can be reduced.

Next, description is given regarding experiments carried out using the developing device 44 according to the first embodiment. In these experiments, conveyance amount of developer layer per unit area ($cm^2$) was measured and evaluations of image density were carried out. In the experiments, experiment objects included a practical example 1 in which the sheet member 70 was used and the developer returning member 50 was formed from a nonmagnetic material, a practical example 2 in which the sheet member 70 was used, but the developer returning member 50 was formed from a magnetic material of SUS430, and a comparative example 1 in which the developer returning member 50 formed from a nonmagnetic material was used, but the sheet member 70 was not used.

Furthermore, the size of the step 60 was set to 1 mm and an acrylic sheet having a thickness of 125 μm was used as the sheet member 70. Furthermore, in consideration of variation in the gap G between the developing sleeve 24 and the first regulating surface 32, evaluations of the developer layer conveyance amounts were carried out using, as a reference, a location where the size of the gap G was 0.3 mm and a location where the size of the gap was 0.4 mm. Image densities were evaluated based on measurement results of a reflection densitometer. The evaluations were carried out after the developing devices 44 in the practical example 1, practical example 2 and the comparative example 1 were operated for two hours. Experiment results are shown in FIG. 4. It should be noted that in FIG. 4, in the case where the reflection density is 1.2 or higher, the image density is evaluated as favorable (○), and conversely in the case where the reflection density is less than 1.2, the image density is evaluated as poor (x).

In the case where the size of the gap G was 0.3 mm, the variation in the developer layer conveyance amount was small in the practical example 1, practical example 2, and the comparative example 1, but in the case where the size of the gap G was 0.4 mm, the variation became larger. In the practical example 1, the sheet member 70 was used and the developer returning member 50 made of the nonmagnetic material was used, and therefore the developer layer conveyance amount was substantially constant both for the case of the gap G size of 0.3 mm and the case of the gap G size of 0.4 mm. That is, in the practical example 1, in both the case of the gap G size being 0.3 mm and the case of the gap G size being 0.4 mm, the layer thickness of the developer layer was substantially uniform. In accordance with these measurement results, the image density was evaluated as favorable (○).

In the practical example 2, although the sheet member 70 was used, the developer returning member 50 made of the magnetic material was used, and therefore the magnetic shield was disturbed, and as a result the developer layer conveyance amount increased in the case of the gap G size of 0.4 mm. Although the layer thickness of the developer layer was not uniform in the practical example 2 compared to the practical example 1, the image density was evaluated as favorable (○).

In the comparative example 1, although the developer returning member 50 made of the nonmagnetic material was used, the sheet member 70 was not used, and therefore the developer accumulated undesirably in the step 60 between the first regulating surface 32 and the second regulating surface 51, and as a result the developer layer conveyance amount greatly increased in the case where the gap G was 0.4 mm. That is, in the comparative example 1, developer layer of uniform layer thicknesses could not be formed. In accordance with these measurement results, the image density was evaluated as poor (x).

As is evident from the above results, the favorable toner images were formed in the practical example 1 and practical example 2 using the sheet member 70 whereas favorable toner images were not formed in the comparative example 1 in which the sheet member 70 was not used.

Second Embodiment

Figure 5:
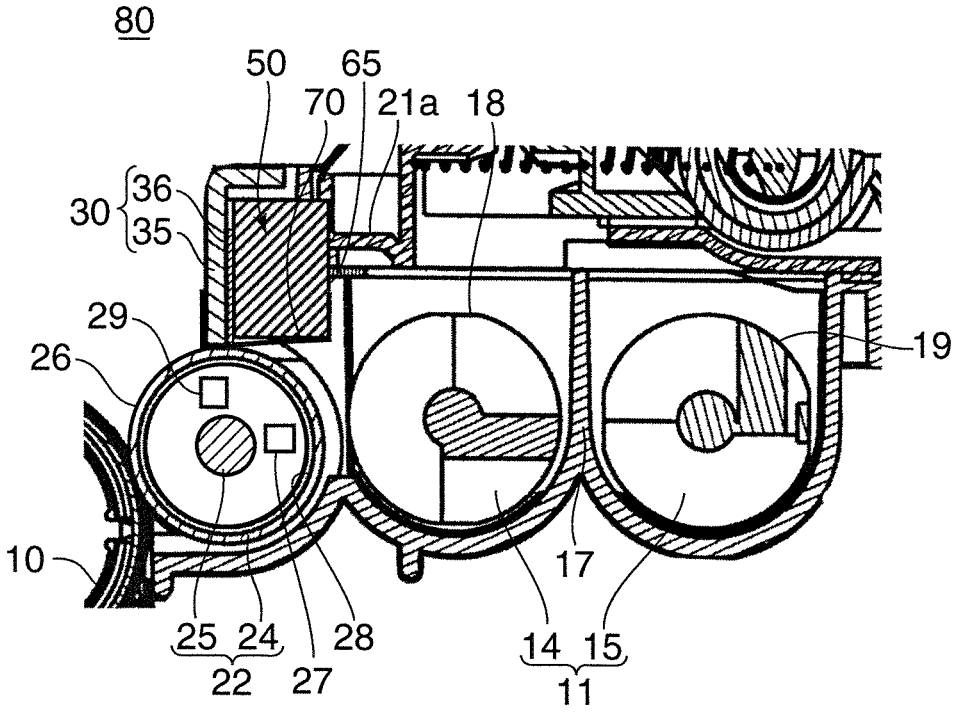
FIG. 5 is an enlarged view of a developing device according to a second embodiment.
Figure 6:
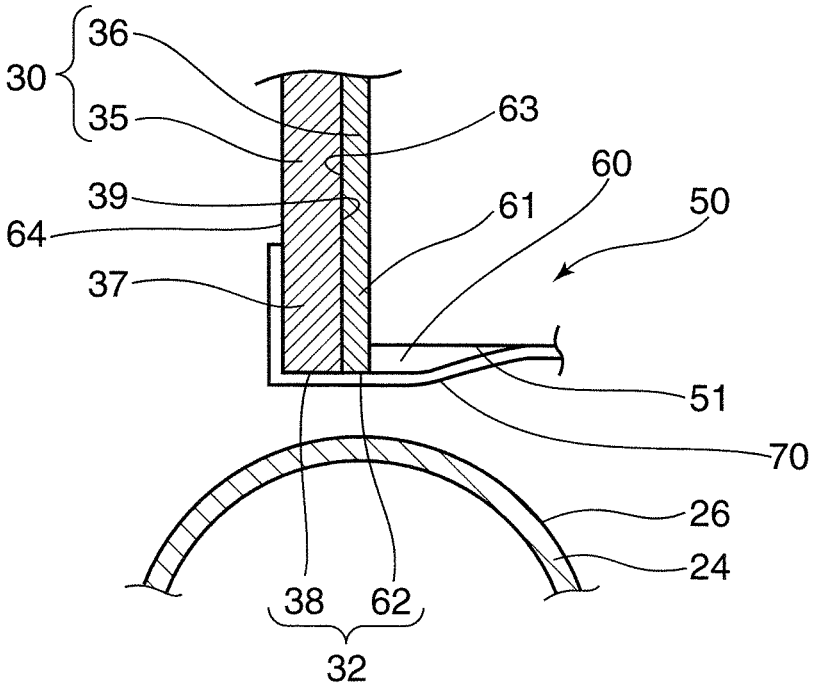
FIG. 6 is an enlarged view of a developer regulating blade of the developing device of FIG. 5.

Next, description is given regarding a developing device 80 according to a second embodiment with reference to FIG. 5 and FIG. 6. In the second embodiment, the developer regulating blade 30 includes a first blade portion 35 that is formed from a nonmagnetic material such as aluminum and a second blade portion 36 that is formed from a magnetic material such as SUS430.

The first blade portion 35 is a plate shaped member extending along the axial direction of the developing sleeve 24 and is provided with an end 37 extending toward the outer circumferential surface 26 of the developing sleeve 24. The end 37 is provided with a first opposing surface 38 that opposes the outer circumferential surface 26 of the developing sleeve 24.

The second blade portion 36 is a plate shaped member extending along the axial direction of the developing sleeve 24 in the same manner as the first blade portion 35, and is positioned on one side surface 39 of the first blade portion 35 facing the inside space of the development vessel 21, or in other words, is positioned more upstream side than the first blade portion 35 as viewed from the rotation direction of the developing sleeve 24. Furthermore, the second blade portion 36 is provided with an end 61 extending toward the outer circumferential surface 26 of the developing sleeve 24. The end 61 is provided with a second opposing surface 62 that opposes the outer circumferential surface 26 of the developing sleeve 24.

The first blade portion 35 and the second blade portion 36 are joined through surfaces that oppose each other in the axial direction of the developing sleeve 24. Specifically, a right side surface 39 in FIG. 6 of the first blade portion 35 and a left side surface 63 in FIG. 6 of the second blade portion 36 are joined to each other. Bonding or welding can be given as examples of joining methods. In a state in which the first blade portion 35 and the second blade portion 36 are joined, the first opposing surface 38 and the second opposing surface 62 constitute the first regulating surface 32. It is preferable that the first opposing surface 38 and the second opposing surface 62 are flush to each other.

In the second embodiment also, the sheet member 70 is attached from the first regulating surface 32 to the second regulating surface 51. Specifically, the sheet member 70 is attached extending from the other side surface (left side surface in FIG. 6) 64 of the first blade portion 35 facing the outside of the development vessel 21, via the first opposing surface 38 and the second opposing surface 62 that constitute the first regulating surface 32 and the second regulating surface 51, until a right side surface 65 of the developer returning member 50 in FIG. 5. Accordingly, the step 60 between the second opposing surface 62 that constitutes the first regulating surface 32 and the second regulating surface 51 of the developer returning member 50 is covered by the sheet member 70. It should be noted that other elements of the configuration in the second embodiment are the same as the first embodiment, and therefore description thereof is omitted.

Incidentally, due to factors such as dimensional precision and in particular thermal deformation caused by welded joining of the first blade portion 35 and the second blade portion 36, a slight gap tends to occur easily between the first blade portion 35 and the second blade portion 36, that is, between the right side surface 39 of the first blade portion 35 and the left side surface 63 of the second blade portion 36. When developer becomes stuck in the gap, the developer deteriorates.

Furthermore, in the case where the first blade portion 35 and the second blade portion 36 are joined by welding, there is a problem such as the following. In a cutting process prior to welding, a cutting oil is used on the first blade portion 35 and the second blade portion 36, and although the cutting oil is washed and removed after the cutting process, it cannot be considered to be entirely removed, so that the cutting oil remains on the first blade portion 35 and the second blade portion 36. Even in the case where the first blade portion 35 and the second blade portion 36 are joined by welding, the first blade portion 35 and the second blade portion 36 are not entirely in close contact with each other, and therefore a solvent that is used in a washing process after the welding process enters into the slight gap between the first blade portion 35 and the second blade portion 36 due to a capillary action. When the solvent enters the gap, the residual cutting oil becomes suspended in the solvent. When the developer regulating blade 30 is mounted into the developing device 80 in this state and the developing device 80 is operated, a pressure is applied on the developer regulating blade 30 by the developer, so that the solvent in which the cutting oil is suspended seeps out from between the first blade portion 35 and the second blade portion 36, thereby causing the toner to undesirably adhere to the first regulating surface 32 of the developer regulating blade 30. As a result, streaks are formed undesirably in the developer layer, and streak noise occurs in the toner image.

However, in the second embodiment, the first opposing surface 38 of the first blade portion 35 and the second opposing surface 62 of the second blade portion 36 are covered by the sheet member 70, and therefore the developer can be prevented from being stuck in the gap, and even if a washing solvent seeps out from between the first blade portion 35 and the second blade portion 36, toner can be prevented from adhering to the first regulating surface 32. Due to this, developer deterioration and occurrences of streak noise in the toner image are prevented. Furthermore, since the sheet member 70 is used, it is unnecessary to carry out a task involving time and effort in selecting the developer regulating blade 30 in which no gap is formed between the first blade portion 35 and the second blade portion 36.

Further still, the developer regulating blade 30 includes the first blade portion 35, which is constituted by a nonmagnetic material, and the second blade portion 36, which is constituted by a magnetic material, and therefore while a magnetic shield is formed between the regulating pole 29 inside the developing sleeve 24 and the second blade portion 36, no magnetic shield is formed between the regulating pole 29 and the first blade portion 35. Due to this, the developer is strongly adhered mainly to the upstream side of the first regulating surface 32. As a result, the regulating force of the first regulating surface 32 increases, and a stabilized developer layer can be formed.

Furthermore, the step 60 between the first regulating surface 32 and the second regulating surface 51 is covered by the sheet member 70 in the same manner as the first embodiment, and therefore it is possible to suppress deterioration of the developer and the developer layer of a uniform layer thickness can be formed on the outer circumferential surface 26 of the developing sleeve 24, thus enabling a favorable toner image to be formed.

Third Embodiment

Figure 7:
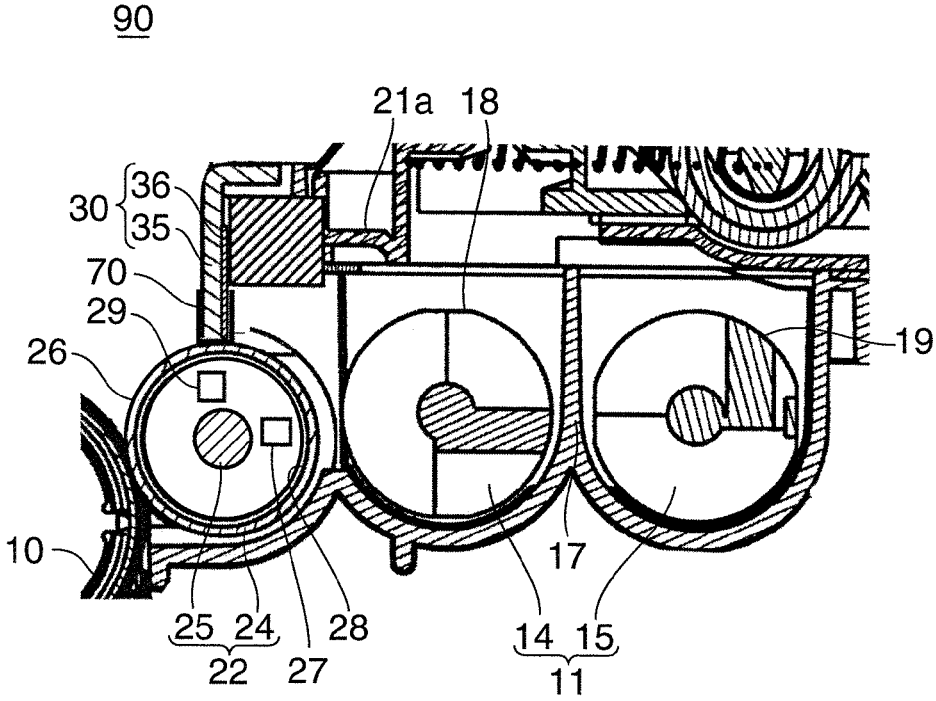
FIG. 7 is an enlarged view of a developing device according to a third embodiment.
Figure 8:
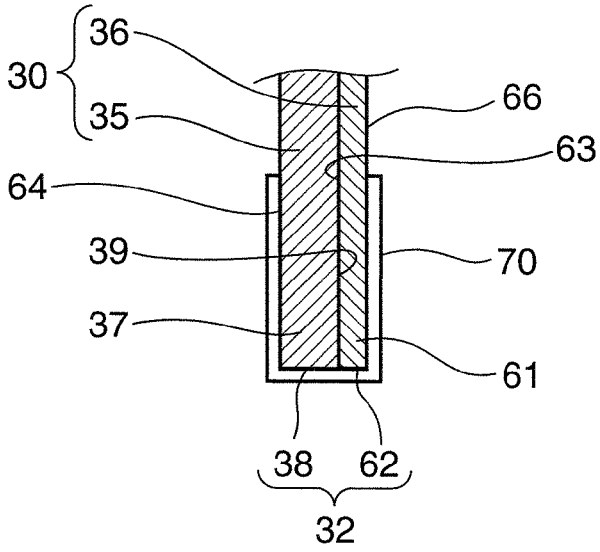
FIG. 8 is an enlarged view of a developer regulating blade of the developing device of FIG. 7.

FIG. 7 shows a developing device 90 according to a third embodiment. Except for the feature that the developer returning member 50 is not used, the configuration of the third embodiment is the same configuration as the second embodiment. In the third embodiment, since the developer returning member 50 is not used, the sheet member 70, as shown in FIG. 8, is attached from one side surface (right side surface in FIG. 8) 66 of the second blade portion 36 of the developer regulating blade 30 facing the inside space of the development vessel 21, via the second opposing surface 62 of the second blade portion 36 and the first opposing surface 38 of the first blade portion 35, which constitute the first regulating surface 32, extending to a side surface (left side surface in FIG. 8) 64 facing outside the developing device 90 at the first blade portion 35.

In the third embodiment also, the first opposing surface 38 of the first blade portion 35 and the second opposing surface 62 of the second blade portion 36 are covered by the sheet member 70, and therefore the developer can be suppressed from being stuck in the gap between the first blade portion 35 and the second blade portion 36, and even if a washing solvent seeps out from between the first blade portion 35 and the second blade portion 36, the solvent can be prevented from leaking to the outer circumferential surface 26 of the developing sleeve 24. Due to this, developer deterioration and occurrences of streak noise are suppressed.

Next, description is given regarding experiments carried out using the developing devices 80 and 90 according to the second embodiment and the third embodiment. In these experiments, evaluations were carried out regarding a state of magnetic brush, that is, a uniformity of layer thickness in the developer layer, streak noise, and image density. Experiment objects included the developing device 80 according to the second embodiment (practical example 3), the developing device 90 according to the third embodiment (practical example 4), a comparative example 2 in which the sheet member 70 was removed from the developing device 80 of the practical example 3, and a comparative example 3 in which the sheet member 70 was removed from the developing device 90 of the practical example 4.

Furthermore, a size of the step 60 was set to 1 mm and a PET film having a thickness of 25 μm was used as the sheet member 70. After the developing devices 44 in the practical example 3, practical example 4, the comparative example 2, and comparative example 3 were operated for two hours, the evaluations were made for the state of magnetic brush, streak noise, and image density. Experiment results are shown in FIG. 9. It should be noted that the state of magnetic brush was evaluated as (○) in the case where the magnetic brush state was visually favorable, and was evaluated as (x) in the case where streaks were clearly confirmed. In regard to streak noise, the evaluation was given as (○) in the case where the toner image was favorable, and was given as (x) in the case where streak noise was confirmed. Image densities were evaluated based on measurement results of a reflection densitometer. In the case where the reflection density was 1.2 or higher, the image density was evaluated as favorable (○), in the case where the reflection density was 1.0 to 1.2, the image density was evaluated slightly poor (Δ), and in the case where the reflection density was less than 1.0, the image density was evaluated as poor (x).

In regard to the state of magnetic brush and streak noise, in contrast to the practical example 3 and practical example 4 in which favorable developer layers were formed without streaks, thereby enabling favorable toner images to be formed free of streak noise since the sheet member 70 was used to cover the first opposing surface 38 of the first blade portion 35 and the second opposing surface 62 of the second blade portion 36, in the comparative example 2 and comparative example 3, since the sheet member 70 was not used, streaks were produced undesirably in the developer layers, and streak noise appeared undesirably in the toner images.

In regard to image densities, these were favorable in the practical example 3. In the practical example 4, although the state of magnetic brush was favorable and streak noise was not confirmed, since the developer returning member 50 was not used, the image densities were slightly poor.

Fourth Embodiment

Figure 10:
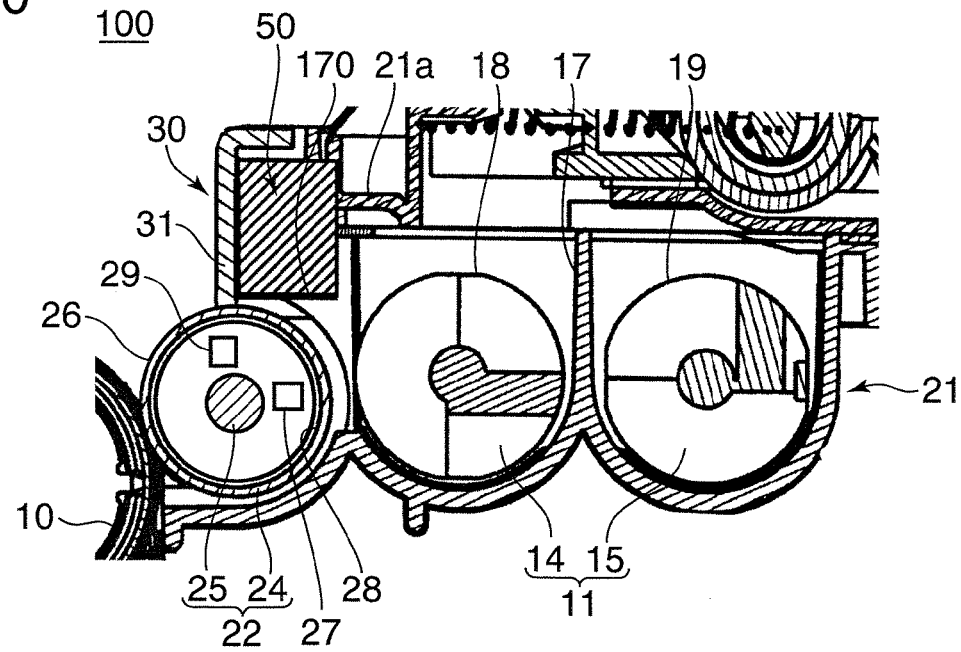
FIG. 10 is an enlarged view of a developing device according to a fourth embodiment.
Figure 11:
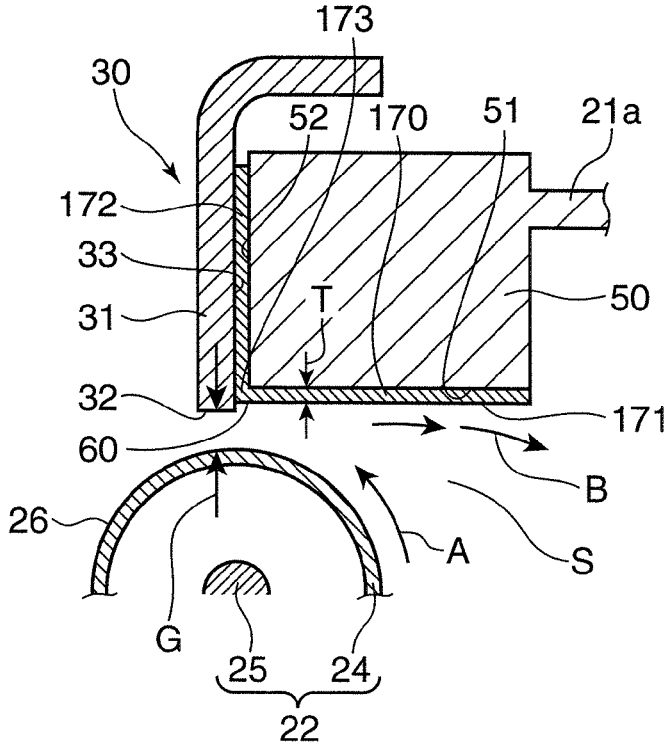
FIG. 11 is an enlarged view of a regulating means and peripheral portions thereof in the developing device of FIG. 10.

Next, description is given regarding a developing device 100 according to a fourth embodiment with reference to FIG. 10 and FIG. 11. In the fourth embodiment, an elastic sheet member 170 is employed in addition to the developer regulating blade 30 and the developer returning member 50 as means for forming a developer layer of a uniform layer thickness on the outer circumferential surface 26 of the developing sleeve 24.

The elastic sheet member 170 is provided with elasticity and is a flat shaped sheet member constituted by a nonmagnetic material, and extends in the axial direction of the developing sleeve 24 and across substantially the entire width direction of the developer regulating blade 30 (that is, the axial direction of the developing sleeve 24). The elastic sheet member 170 is attached to the second regulating surface 51 of the developer returning member 50 so as to cover at least a portion of the step 60. Specifically, an end portion 173 of the elastic sheet member 170, which is positioned on the side of the developer regulating blade 30, extends inside the step 60 so as to partially occupy a space defined by the step 60. The developer regulating blade 30 has an opposing surface 33 that is oriented toward an upstream side as viewed from the rotation direction of the developing sleeve 24 and faces the inside space of the development vessel 21. The end portion 173 of the elastic sheet member 170 is in close contact with the opposing surface 33. It should be noted that the attaching of the elastic sheet member 170 to the second regulating surface 51 can be carried out using a double-sided tape or adhesive, but there is no particular limitation.

The elastic sheet member 170 has a flat surface 171 that opposes the outer circumferential surface 26 of the developing sleeve 24. Since the elastic sheet member 170 is attached to the second regulating surface 51, the flat surface 171 is positioned more upstream than the first regulating surface 32 of the developer regulating blade 30 as viewed from the rotation direction of the developing sleeve 24, and is set so as to gradually become apart from the developing sleeve 24 toward the upstream side of the rotation direction. In other words, the flat surface 171 is set so that a space S between the flat surface 171 and the outer circumferential surface 26 of the developing sleeve 24 gradually increases toward the upstream side in the rotation direction of the developing sleeve 24 from the first regulating surface 32 of the developer regulating blade 30. In fact, the flat surface 171 of the elastic sheet member 170 acts as a conveyance amount regulating surface that regulates the amount of the developer conveyed to the first regulating surface 32.

In addition to a material provided with elasticity as described above, a material for the elastic sheet member 170 is selected from materials having the same polarity as the toner of the developer. Specifically, in a case where the toner stirred inside the developer storage chambers 14 and 15 is negatively charged by the carrier, examples of materials that can be used as the elastic sheet include resin films such as PET, PTFE, acrylic, nylon, high molecular weight PE, PPS, PI, and polycarbonate, rubber sheets such as polyurethane, silicone rubber, fluorocarbon rubber, NBR, and SBR, and sponge sheets. On the other hand, in a case where the toner is positively charged, examples of materials that can be used as the elastic sheet member 170 include nylon, urethane, high molecular PE, and acrylic.

A thickness T of the elastic sheet member 170 is set within a range of 1 mm to 4 mm. In a case where the elastic sheet member 170 is constituted by urethane, the thickness T is set to 4 mm for example. It should be noted that in FIG. 11, the thickness T of the elastic sheet member 170 is illustrated in an exaggerated manner to clarify the configuration.

Furthermore, the elastic sheet member 170 has an extension portion 172 that extends from the end portion 173 and is positioned between the developer regulating blade 30 and the developer returning member 50. Specifically, in addition to the second regulating surface 51, the developer returning member 50 has an opposing surface 52 that opposes the opposing surface 33 of the developer regulating blade 30. The opposing surface 52 of the developer returning member 50 extends across substantially the entire width direction of the developer regulating blade 30. The extension portion 172 extends from a position near a corner between the second regulating surface 51 and the opposing surface 52 and along the opposing surface 52 and the opposing surface 33. Furthermore, the extension portion 172 is attached closely to the opposing surface 52 so that no gap is formed between the opposing surface 52 and the opposing surface 33. The developer regulating blade 30 is secured to the opposing surface 52 of the developer returning member 50 through the extension portion 172 using an unshown securing member (for example, a screw).

In the developing device 100 according to the fourth embodiment, a developer layer having a uniform layer thickness is formed in a following manner. Namely, the developer that has adhered to the outer circumferential surface 26 of the developing sleeve 24 from the developer storage chamber 14 due to the take-up pole 27 gradually approaches the flat surface 171 of the elastic sheet member 170 along with rotation of the developing sleeve 24 as shown by an arrow A. The developer is conveyed to the space S between the flat surface 171 and the outer circumferential surface 26 of the developing sleeve 24, but the space S narrows toward the downstream side in the rotation direction of the developing sleeve 24. For this reason, a portion of the developer being conveyed is gradually pushed back in an opposite direction (arrow B) to the rotation direction of the developing sleeve 24 by the flat surface 171 and returns to the developer storage chamber 14. In this way, the amount of the developer conveyed to the first regulating surface 32 is regulated using the flat surface 171. Due to this, the developer is suppressed from accumulating in large amounts on the upstream side in the gap as viewed from the rotation direction of the developing sleeve 24.

Then, as the developer passes the gap G, the layer thickness of the developer is regulated by the first regulating surface 32 of the developer regulating blade 30 and an effect of the magnetic shield. Due to this, a developer layer of a predetermined thickness, a so-called magnetic brush layer, is uniformly formed on the outer circumferential surface 26 of the developing sleeve 24.

With the developing device 100 according to the fourth embodiment described above, the end portion 173 of the elastic sheet member 170 extends inside the step 60 so as to partially occupy the space defined by the step 60, and therefore the amount of the developer that accumulates in the step 60 is reduced. Due to this, it is possible to form a uniform layer thickness of developer on the outer circumferential surface 26 of the developing sleeve 24, and thus also possible to form a favorable toner image.

Furthermore, the flat surface 171 of the elastic sheet member 170 is set so as to gradually be apart from the developing sleeve 24 toward the upstream side in the rotation direction of the developing sleeve 24, and therefore a large amount of the developer is suppressed from accumulating on the upstream side of the developer regulating blade 30. And since the elastic sheet member 170 is a thin member whose thickness is set to 1 mm to 4 mm, the extent of thermal deformation caused by heat produced within the developing device 100 is small. For this reason, thermal deformation of the elastic sheet member 170 and thus also the flat surface 171 can be suppressed. Due to this, unlike conventional configurations, the accumulation of the developer caused by thermal deformation, and therefore developer deterioration can be suppressed.

Further still, a large amount of the developer is suppressed from accumulating on the upstream side of the developer regulating blade 30, and therefore the magnetic line produced between the first regulating surface 32 of the developer regulating blade 30 and the regulating pole 29 can be stabilized and focused on the first regulating surface 32. As a result, it is possible to form a uniform layer thickness of the developer layer on the outer circumferential surface 26 of the developing sleeve 24, and thus also possible to form a favorable toner image. Further still, since the elastic sheet member 170 is provided with elasticity, the stress the elastic sheet member 170 receives from the flat surface 171 when the developer contacts the flat surface 171 can be reduced.

Further still, the elastic sheet member 170 is formed from a material having the same polarity as the charged polarity of the toner, and therefore the toner tends not to adhere to the flat surface 171 of the elastic sheet member 170. Due to this, accumulation of the developer caused by such adherence is suppressed.

Further still, the elastic sheet member 170 is formed from a nonmagnetic material, and therefore the magnetic flux density between the first regulating surface 32 of the developer regulating blade 30, which is formed from a magnetic material, and the regulating pole 29 of the developing roller 22 is increased, and the magnetic shield is not disturbed. Due to this, it becomes easy to uniformly regulate the layer thickness of the developer.

Further still, the extension portion 172 of the elastic sheet member 170 is interposed between the opposing surface 33 of the developer regulating blade 30 and the opposing surface 52 of the developer returning member 50, and therefore vibrations accompanying developing operations of the developing device 100 tend not to be transmitted from the developer returning member 50 to the developer regulating blade 30. Due to this, the secured state of the developer regulating blade 30 to the developer returning member 50 is maintained without slackening caused by the vibrations. As a result, not only can the layer thickness of developer on the developing sleeve 24 be favorably regulated, it becomes unnecessary to use a shock absorbing member such as a sponge, which is a separate member, between the opposing surface 33 and the opposing surface 52. Furthermore, the extension portion 172 is attached in close contact to the opposing surface 52 so that no gap is not formed between the opposing surface 33 of the developer regulating blade 30 and the opposing surface 52 of the developer returning member 50, and therefore the developer is suppressed from leaking out from between the opposing surface 33 and the opposing surface 52. In this way, the extension portion 172 of the elastic sheet member 170 acts as a shock absorbing member and a seal member.

The developing devices 44, 80, 90, and 100 according to the first to fourth embodiments described above were described using a case in which they were applied to a monochrome type image forming apparatus, but the developing devices 44, 80, 90, and 100 according to the first to fourth embodiments can also be applied to a tandem type image forming apparatus.

This application is based on Japanese Patent application serial Nos. 2009-214271 and 2009-214269 filed in Japan Patent Office on Sep. 16, 2009, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. A developing device, comprising:

a developer storing portion storing a developer containing a nonmagnetic toner and a magnetic carrier;

a developer carrying body receiving the developer from the developer storing portion to supply the developer to a predetermined image carrying body while rotating in a predetermined direction;

a first regulating member having a first regulating surface that opposes the developer carrying body and regulates a layer thickness of the developer carried on the developer carrying body;

a second regulating member having a second regulating surface that is positioned more upstream than the first regulating surface with respect to a rotation direction of the developer carrying body and that is set so as to become apart from the developer carrying body toward the upstream side with respect to the rotation direction of the developer carrying body to regulate an amount of the developer conveyed to the first regulating surface, the second regulating surface being arranged with a step formed between the second regulating surface and the first regulating surface; and a sheet member so attached to the second regulating surface as to cover the step between the first regulating surface and the second regulating surface, wherein the sheet member is attached to extend from the second regulating surface onto the first regulating surface, and a gap of a predetermined size is set through the sheet member between the first regulating surface of the first regulating member and the developer carrying body.

2. The developing device according to claim 1, wherein the sheet member has an extension portion that extends exceeding a downstream edge of the first regulating surface with respect to the rotation direction of the developer carrying body.

3. The developing device according to claim 1, wherein the first regulating member is formed from a magnetic material, the second regulating member is formed from a nonmagnetic material, and the developer carrying body has a magnet forming a magnetic path between the magnet and the first regulating member.

4. The developing device according to claim 1, further comprising a housing accommodating the developer storing portion, the developer carrying body, the first regulating member and the second regulating member, wherein the second regulating member is formed integrally with the housing.

5. The developing device according to claim 1, wherein the first regulating member has a first portion formed from a nonmagnetic material, and a second portion formed from a magnetic material and positioned more upstream than the first portion with respect to the rotation direction of the developer carrying body, the first portion and the second portion have a first opposing surface and a second opposing surface, respectively, the first and second opposing surfaces forming the first regulating surface, the first portion and the second portion are joined, and the sheet member is attached to extend from the first opposing surface to the second opposing surface.

6. The developing device according to claim 1, wherein the sheet member is an elastic sheet member having elasticity.

7. The developing device according to claim 6, wherein the first regulating member is formed from a magnetic material, the elastic sheet member is formed from a nonmagnetic material, and the developer carrying body has a magnet forming a magnetic path between the magnet and the first regulating member.

8. An image forming apparatus, comprising:

an image carrying body on which a toner image is formed;

a developing device supplying a developer to the image carrying body to form the toner image on the image carrying body;

a transfer member transferring the toner image onto a sheet; and a fixing unit fixing the toner image onto the sheet, wherein the developing device includes:

a developer storing portion storing a developer containing a nonmagnetic toner and a magnetic carrier;

a developer carrying body receiving the developer from the developer storing portion to supply the developer to a predetermined image carrying body while rotating in a predetermined direction;

a first regulating member having a first regulating surface that opposes the developer carrying body and regulates a layer thickness of the developer carried on the developer carrying body;

a second regulating member having a second regulating surface that is positioned more upstream than the first regulating surface with respect to a rotation direction of the developer carrying body and that is set so as to become apart from the developer carrying body toward the upstream side with respect to the rotation direction of the developer carrying body to regulate an amount of the developer conveyed to the first regulating surface, the second regulating surface being arranged with a step formed between the second regulating surface and the first regulating surface; and a sheet member so attached to the second regulating surface as to cover the step between the first regulating surface and the second regulating surface, wherein the sheet member is attached to extend from the second regulating surface onto the first regulating surface, and a gap of a predetermined size is set through the sheet member between the first regulating surface of the first regulating member and the developer carrying body.

9. The image forming apparatus according to claim 8, wherein the sheet member has an extension portion that extends exceeding a downstream edge of the first regulating surface with respect to the rotation direction of the developer carrying body.

10. The image forming apparatus according to claim 8, wherein the first regulating member is formed from a magnetic material, the second regulating member is formed from a nonmagnetic material, and the developer carrying body has a magnet forming a magnetic path between the magnet and the first regulating member.

11. The image forming apparatus according to claim 8, further comprising a housing accommodating the developer storing portion, the developer carrying body, the first regulating member and the second regulating member, wherein the second regulating member is formed integrally with the housing.

12. The image forming apparatus according to claim 8, wherein the first regulating member has a first portion formed from a nonmagnetic material, and a second portion formed from a magnetic material and positioned more upstream than the first portion with respect to the rotation direction of the developer carrying body, the first portion and the second portion have a first opposing surface and a second opposing surface, respectively, the first and second opposing surfaces forming the first regulating surface, the first portion and the second portion are joined, and the sheet member is attached to extend from the first opposing surface to the second opposing surface.

13. The image forming apparatus according to claim 8, wherein the sheet member is an elastic sheet member having elasticity.

14. The image forming apparatus according to claim 13, wherein the first regulating member is formed from a magnetic material, the elastic sheet member is formed from a nonmagnetic material, and the developer carrying body has a magnet forming a magnetic path between the magnet and the first regulating member.

* * * * *